United States Patent [19]

Wattley et al.

[11] Patent Number: 4,793,150

[45] Date of Patent: Dec. 27, 1988

[54] REFRIGERATION SYSTEM INCLUDING REFRIGERANT NOISE SUPPRESSION

[75] Inventors: Mark D. Wattley, Louisville, Ky.; Douglas D. Dankel, Kankakee, Ill.

[73] Assignee: General Electric Company, Louisville, Ky.

[21] Appl. No.: 193,558

[22] Filed: May 13, 1988

[51] Int. Cl.[4] ..... F25D 19/00

[52] U.S. Cl. ..... 62/296; 62/511

[58] Field of Search ..... 62/296, 511

[56] References Cited

U.S. PATENT DOCUMENTS

| | | | |
|---|---|---|---|
| 2,933,905 | 4/1960 | Simmons | 62/511 |
| 2,967,410 | 1/1961 | Schulze | 62/505 |
| 3,531,947 | 10/1970 | Drury et al. | 62/511 |
| 4,086,782 | 5/1978 | Forsberg | 62/296 |
| 4,169,361 | 10/1979 | Baldus | 62/402 |
| 4,381,651 | 5/1983 | Kubo et al. | 62/296 |
| 4,408,467 | 10/1983 | Murnane et al. | 62/296 |
| 4,445,343 | 5/1984 | McCarty | 62/511 X |

*Primary Examiner*—Lloyd L. King

*Attorney, Agent, or Firm*—Frederick P. Weidner; Radford M. Reams

[57] ABSTRACT

A refrigeration system comprising in closed series-flow relationship, a condenser, a capillary tube flow restrictor, and an evaporator including means connecting the outlet end of the restrictor to the evaporator inlet for reducing the noise generated by refrigerant flowing from the restrictor.

4 Claims, 2 Drawing Sheets

REFRIGERATION SYSTEM INCLUDING REFRIGERANT NOISE SUPPRESSION

BACKGROUND OF THE INVENTION

A well known refrigeration system includes in closed series-flow relationship, an evaporator, a compressor for withdrawing refrigerant from the evaporator, a condenser for condensing the refrigerant compressed by the compressor and tubular flow restrictor means commonly called a capillary tube for controlling the flow of refrigerant to the evaporator. The capillary tube maintains the desired pressure differential between the condenser and the evaporator by restricting the flow of refrigerant therethrough and to this end its internal diameter is substantially less than the internal diameter of the conduit forming the inlet end of the evaporator. Because of the difference in diameter between the capillary tube and the inlet end of the evaporator, it is common to have a jumper tube that is intermediate and joined to each of the capillary tube and the inlet end of the evaporator to act as a transition section. One of the problems in joining the jumper tube to the capillary tube is that they must be joined without any leaks and because the capillary tube diameter is so small the metal joining operation, such as brazing, must be such that the alloy or flux used in the brazing operation to join the two tubes will not clog the opening of the capillary tube or introduce alloy or flux into the refrigerant system.

The refrigerant exiting from the capillary tube may be in the form of liquid or gas or a mixture of the two. Also, as the refrigerant exits from the capillary tube, a portion of it usually vaporizes at the lower pressure condition in the evaporator. The boiling turbulence resulting from this vaporization as well as the exit velocity of the refrigerant, which is close to sonic speed, constitute a major source of noise in the operation of a refrigeration system. This noise can be quite bothersome in the operation of refrigerant systems such as those contained in refrigerators. Particularly bothersome is the noise generated after the refrigeration system is shut down and the refrigerant system pressure is equalizing. During that time the compressor and fans are off so they do not help mask the noise.

By this invention there is provided a structural arrangement that suppresses the noise created by refrigerant exiting the capillary tube and also the structural arrangement prevents clogging of the outlet end of the capillary tube during the metal joining operation between capillary tube and the jumper tube.

SUMMARY OF THE INVENTION

In a refrigeration system including a condenser, an evaporator having a tubular inlet and a capillary tube flow restrictor for controlling the flow of refrigerant from said condenser to said evaporator and having a flow restriction sufficient to maintain the desired range of pressure differential between said condenser and said evaporator there is provided a jumper tube for connecting the outlet end of said capillary tube to said evaporator inlet. The jumper tube comprises at least five successive tubular sections including a first section having an inside diameter slightly larger than the outside diameter of the capillary tube. A second section of the jumper tube having a conical shape and in fluid flow communication with the first section has a diameter increasing in size in a direction away from the first section. A third section of the jumper tube is in fluid flow communication with the second section and has an inside diameter substantially larger than the outside diameter of the capillary tube. A fourth section of the jumper tube has a conical shape and is in fluid flow communication with the third section and has a diameter increasing in a direction away from the third section. A fifth section of the jumper tube is in fluid flow communication with the fourth section and has a diameter larger than the third section. The capillary tube is arranged to extend through the first and second sections of the jumper tube and into the third section a distance of between 12 and 88 percent of the length of the third section and is secured to the first section of the jumper tube by suitable means, usually by a metal joining operation.

With the arrangement described there is a controlled expansion of the refrigerant by creating a gradual reduction of pressure and vibrations of the end of the capillary tube are reduced, both of which contribute to noise suppression. Moreover, during the metal joining operation the capillary tube outlet is not clogged and the refrigerant system is not contaminated by materials used in the metal joining operation.

DESCRIPTION OF THE PREFERRED EMBODIMENT

Figure 1:
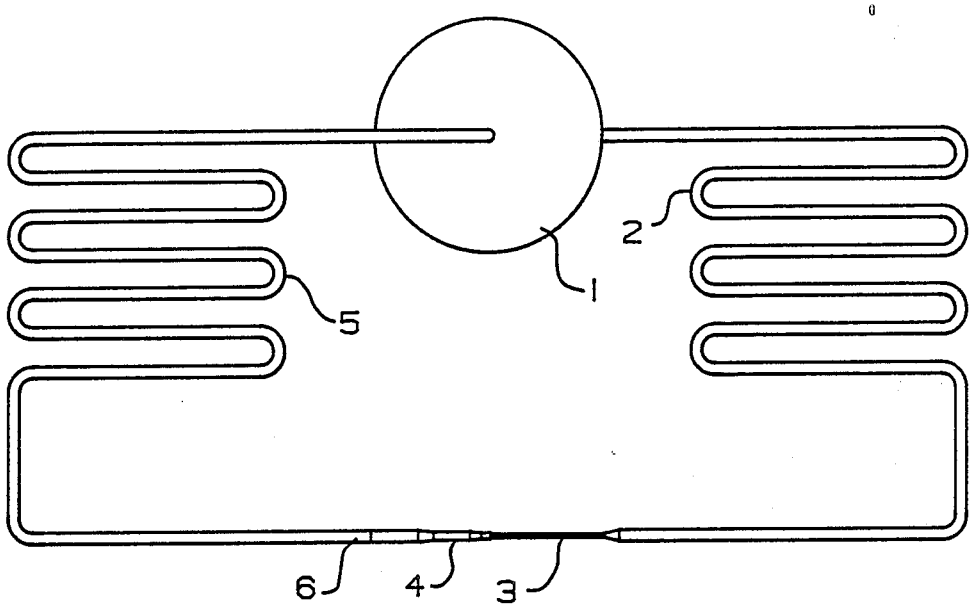
FIG. 1 is a schematic diagram of a closed refrigeration system incorporating the present invention.

With reference to FIG. 1 of the accompanying drawing, there is illustrated diagrammatically a refrigeration system including a compressor 1, a condenser 2, a tubular flow restrictor, such as a capillary tube 3, the improved connecting means or jumper tube 4 of the present invention and an evaporator 5 connected in closed series-flow relationship. In the operation of such a system, the compressor 1 withdraws refrigerant vapor from the evaporator 5 and discharges compressed refrigerant to the condenser 2. The high pressure refrigerant condensed in the condenser 2 passes through the capillary tube 3 to the evaporator 5. The capillary tube 3 provides a substantial restriction to the flow of liquid refrigerant to the evaporator and thereby maintains the desired range of pressure differential between the condenser and the evaporator in a well known manner.

To maintain such pressure differential, the internal diameter of the capillary tube 3 is substantially smaller than the remaining fluid passages in the refrigeration system including the inlet end 6 of the evaporator 5. In previously known refrigeration systems of this type, such as those specifically used in household refrigerators, the outlet end of the capillary tube 3 was connected directly to the inlet end 6 of the evaporator, or to a suitable non-restrictive tubular connection having substantially the same diameter as the evaporator tubing or conduit, employing suitable means for plugging the space between the outer surface of the capillary tube and the inner surface of the evaporator inlet. With such a direct connection, the refrigerant in the form of either a liquid or a gas or a mixture thereof issued from the outlet end of the relatively small capillary tube at a relatively high velocity close to sonic speed. Also, as this refrigerant exited from the capillary tube to the larger diameter evaporator conduit operating at compressor suction pressures, some of the liquid refrigerant flashed into gas at this lower pressure resulting in a turbulent and noise producing flow at the inlet to the evaporator. This noise may be described as a roaring sound, accompanied in certain cases believed to result from the use of a condenser which alternatively feeds gas and liquid slugs to the capillary, by a relatively loud popping sound similar to that of popping corn.

One means of eliminating the roaring noise and popping sound is described in U.S. Pat. No. 3,531,947, assigned to the same assignee as this invention, wherein a connector between the capillary outlet and the evaporator inlet comprises a plurality of telescoping tubular segments or sections. The invention described in that patent, however, did not address the problem of how to join the capillary tube 3 to the first section of the telescoping tubular segments without risk of plugging the end of the capillary tube with materials used in the metal joining operation. It will be noted that in that patent the capillary tube is inserted into a section having a constant diameter substantially the same as the outside diameter of the capillary tube and the capillary tube is inserted only a short distance relative to the length of the first telescoping section. Presumably the capillary tube is joined to the first section by soldering or brazing. Such an arrangement as shown and described in the patent could result in plugging the outlet of the capillary tube with materials used in the metal joining operation.

Figure 2:
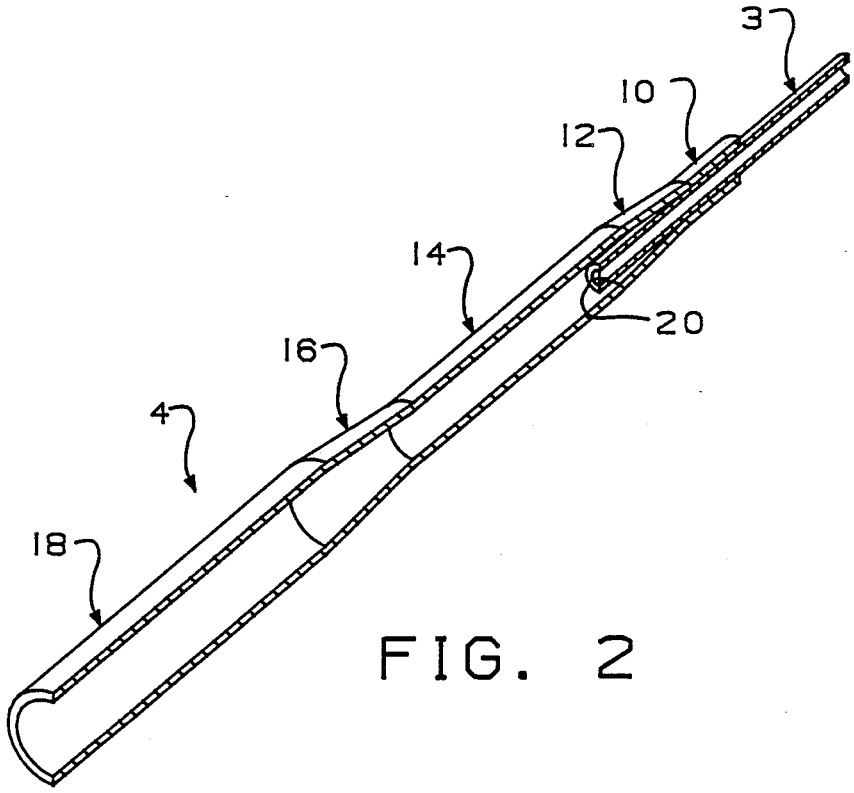
FIG. 2 is an enlarged perspective sectional view of the connecting means forming part of the refrigerating system of FIG. 1.
Figure 3:
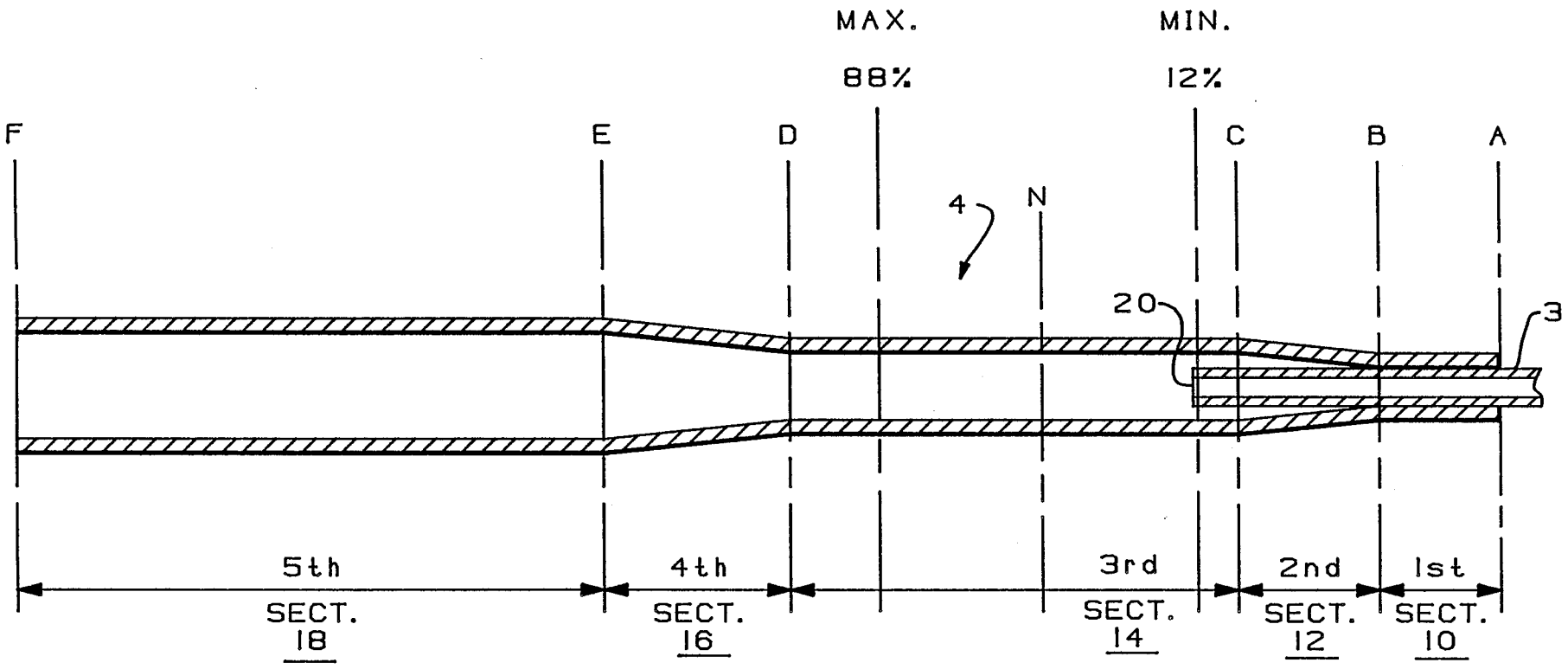
FIG. 3 is a greatly enlarged sectional view of the connecting means forming part of the refrigerating system of FIG. 1.

With reference particularly to FIGS. 2 and 3, the jumper tube 4 configuration of the present invention is shown in detail. The jumper tube comprises at least five successive tubular sections including a first section 10 shown in FIG. 1 between vertical lines A and B and this section has an inside diameter slightly larger than the outside diameter of the capillary tube 3 so that there is in effect a close fit between the capillary tube and the first section 10. The jumper tube has a second section 12 having a conical shape and is in fluid flow communication with the first section 10 and has a diameter increasing in length in the direction away from the first section. The second section is shown in FIG. 3 between vertical lines B and C. The third section 14 is located between vertical lines C and D and is in fluid flow communication with the second section 12 and has an inside diameter substantially larger than the outside diameter of the capillary tube. A fourth section 16 between vertical lines D and E has a conical shape and is in fluid flow communication with the third section 14 and has a diameter increasing in length in a direction away from the third section 14. A fifth section 18 is in fluid flow communication with the fourth section 16 and has a diameter larger than the third section 14 and extends between vertical lines E and F. In manufacturing such jumper tubes it may be advantageous to form the segments from a single piece of tubing, as for example by swagging a portion thereof into a smaller diameter as shown in FIG. 3.

We have found that it is important that the capillary tube 3 have its forward terminal end 20, which is the exit opening from the capillary tube, inserted into the third section 14 of the jumper tube 4 a distance of between 12% and 88% of the length of the third section before the capillary tube 3 is joined to the first section 10 of the jumper tube 4. The reason is that it has been found that noise reduction is accomplished within this range of insertion and that the material used in the metal joining portion does not plug up the capillary tube. The metal joining means is usually a brazing operation or a soldering operation which involves heating the contact area between the capillary tube and the jumper tube and adding a metal alloy that will melt and wet or alloy the surfaces and then freeze in place to form the joint. It is important that the joining operation not produce any leaks at the joint which would detrimentally affect the refrigerant system. To this end, there is commonly used fluxes which prepare the surfaces of the capillary tube and jumper tube in the contact area so that the metal of the capillary tube and jumper tube, usually both copper, may readily accept the joining metal alloy to provide a leakproof joint. Because of the very small exit diameter of the terminal end 20 of the capillary tube, it is important that the material used in the metal joining operation does not inadvertently reach the terminal end 20 resulting in plugging or partially plugging up the end of the capillary tube. Therefore, it is important that the capillary tube 3 have the terminal end 20 inserted sufficiently into the third section of the jumper tube which has a substantially larger diameter than the outside diameter of the capillary tube. By this arrangement if any of the materials of the metal joining operation do find their way into the jumper tube beyond the first section 10, they merely accumulate within the second section 12 around the capillary tube and perhaps in the first portion of the third section 14 between vertical line C and the terminal end 20 of the capillary tube 3 as shown in FIG. 3. It has been found that if the terminal end 20 of the capillary tube is inserted less than 12% of the length of the third section 14, there is some possibility of the capillary tube being plugged by the materials from the metal joining operation. On the other hand, it has also been found that if the terminal end 20 of the capillary tube extends beyond 88% of the length of the third section 14, then the noise reduction is not as effective as the unsupported end of the capillary tube will excessively vibrate and cause noise. The nominal distance is shown as vertical line N in FIG. 3 which represents the middle of the range of 12–88 percent of the length of the third section 14. The optimum distance of insertion into the third section 14 is between the vertical line indicated as minimum 12% and vertical line N in FIG. 3. It has also been found that to achieve the above mentioned desirable characteristics of noise suppression and non-plugging of the capillary tube it is important that the ratio of the outside diameter of the capillary tube 3 relative to the inside diameter of the third section 14 of the jumper tube 4 should remain constant. Also, it has been found that the ratio of the capillary tube outside diameter relative to the combined length of jumper tube sections 2 and 3 should remain constant.

A typical example of a preferred combination jumper tube and capillary tube for the practice of the present invention is illustrated in FIG. 3 of the drawing. The jumper tube was designed to provide an optimum noise suppression and prevent plugging of the terminal end 20 of the capillary tube 3 by materials utilized in the metal joining operation. In the arrangement shown the capillary tube 3 has an outside diameter of 0.081 inches and an inside diameter of 0.031 inches. The length of the first section 10 is 0.25 inches. The third section 14 has an inside diameter of 0.150 inches and the combined length of sections 2 and 3 is 1.25 inches. Section 5 has an outside diameter of 0.290 inches and an inside diameter of 0.234 inches. Thus, utilizing the ratios mentioned above, the inside diameter of the third section 14 of the jumper tube should be approximately 1.8 times larger than the outside diameter of the capillary tube 3. In addition, the combined length of sections 2 and 3 of the jumper tube 4 should be approximately 15 times the outside diameter of the capillary tube 3.

While, in accordance with the Patent Statutes, there has been described what at present is considered to be the preferred embodiment of the invention, it will be obvious to those skilled in the art that various changes and modifications may be made thereto with departing from the invention. It is, therefore, intended by the appended claims to cover all such changes and modifications as fall within the true spirit and scope of the invention.

What is claimed is:

1. In a refrigeration system including a condenser, an evaporator having a tubular inlet and a capillary tube flow restrictor for controlling the flow of refrigerant from said condenser to said evaporator and having a flow restriction sufficient to maintain the desired range of pressure differential between said condenser and said evaporator;

a jumper tube connecting the outlet end of said capillary tube to said evaporator inlet, said jumper tube comprising at least five successive tubular sections including;

a first section having an inside diameter slightly larger than the outside diameter of the capillary tube, a second section having a conical shape and in fluid flow communication with the first section and increasing in diameter in a direction away from the first section, a third section in fluid flow communication with the second section and having an inside diameter substantially larger than the outside diameter of the capillary tube, a fourth section having a conical shape and in fluid flow communication with the third section and increasing in diameter in a direction away from the third section, a fifth section in fluid flow communication with the fourth section and having a diameter larger than the third section, and said capillary tube extending through the first and second sections of the jumper tube and into the third section a distance of between 12% and 88% of the length of the third section and secured to the first section of the jumper tube by suitable means.

2. In the refrigeration system of claim 1 wherein the inside diameter of the third section of the jumper tube is approximately 1.8 times larger than the outside diameter of the capillary tube.

3. In the refrigeration system of claim 1 wherein the capillary tube is secured to the jumper tube by metal joining means as by heating a metal alloy which wets the two tubes and then freezes to join them together.

4. In the refrigeration system of claim 1 wherein the combined length of jumper tube sections two and three is approximately 15 times the outside diameter of the capillary tube.

* * * * *